US006606891B1

(12) United States Patent
McGowan et al.

(10) Patent No.: US 6,606,891 B1
(45) Date of Patent: Aug. 19, 2003

(54) METHOD AND DEVICE FOR CRIMPING COMPOSITE ELECTRICAL INSULATORS

(75) Inventors: Brian McGowan, Mayo (IE); Ronan Kavanagh, Galway (IE)

(73) Assignee: Tyco Electronics UK Limited (GB)

( * ) Notice: Subject to any disclaimer, the term of this patent is extended or adjusted under 35 U.S.C. 154(b) by 0 days.

(21) Appl. No.: 09/890,360

(22) PCT Filed: Jan. 26, 2000

(86) PCT No.: PCT/GB00/00218

§ 371 (c)(1),
(2), (4) Date: Jul. 25, 2001

(87) PCT Pub. No.: WO00/45476

PCT Pub. Date: Aug. 3, 2000

(30) Foreign Application Priority Data

Jan. 26, 1999 (GB) ..... 9901641

(51) Int. Cl.[7] ..... H01R 43/042
(52) U.S. Cl. ..... 72/21.4; 72/402; 29/715
(58) Field of Search ..... 72/21.4, 402, 416, 72/412; 29/705, 753, 720, 715

(56) References Cited

U.S. PATENT DOCUMENTS

| | | | | | |
|---|---|---|---|---|---|
| 4,856,186 | A | * | 8/1989 | Yeomans | 29/705 |
| 4,914,602 | A | * | 4/1990 | Abe et al. | 72/3 |
| 4,916,810 | A | * | 4/1990 | Yeomans | 29/753 |
| 5,092,026 | A | * | 3/1992 | Klemmer et al. | 29/705 |
| 5,101,651 | A | * | 4/1992 | Yeomans | 72/21.4 |
| 5,123,165 | A | * | 6/1992 | Strong et al. | 29/705 |
| 5,168,736 | A | | 12/1992 | Enneper et al. | 72/4 |
| 5,195,042 | A | * | 3/1993 | Ferraro et al. | 72/19.9 |
| 5,197,186 | A | * | 3/1993 | Strong et al. | 29/705 |
| 5,271,254 | A | * | 12/1993 | Gloe et al. | 29/705 |
| 5,491,994 | A | * | 2/1996 | Baldyga | 29/705 |
| 5,877,453 | A | | 3/1999 | Hill | 174/179 |
| 5,901,440 | A | * | 5/1999 | Maeda et al. | 29/705 |
| 6,161,407 | A | * | 12/2000 | Meisser | 72/21.4 |

FOREIGN PATENT DOCUMENTS

| | | |
|---|---|---|
| DE | 4014221 | 11/1990 |
| DE | 298 06 179 | 11/1998 |
| EP | 0 291 329 | 11/1988 |
| EP | 0 397 434 | 11/1990 |
| EP | 0 460 441 | 11/1991 |

OTHER PUBLICATIONS

Copy of International Search Report.
Copy of International Preliminary Examination Report.
Copy of GB 9901641.2 Search Report.

* cited by examiner

*Primary Examiner*—Daniel C. Crane
(74) *Attorney, Agent, or Firm*—Myers Bigel Sibley & Sajovec

(57) ABSTRACT

Methods and apparatus are provided for monitoring crimping of metal end fittings onto electrically insulating core rods. The force and/or pressure applied to the metal end fittings by crimping jaws are monitored during crimping. The distance travelled by the crimping jaws is also measured during crimping. A change is detected in the relationship between the force and/or pressure and the distance travelled by the crimping jaws, such as by detecting a non-increasing force and/or pressure with an increasing distance. The methods and apparatus of the present invention may provide for detection and/or prediction of cracks in the electrically insulating core rods to improve the crimping process.

16 Claims, 3 Drawing Sheets

METHOD AND DEVICE FOR CRIMPING COMPOSITE ELECTRICAL INSULATORS

RELATED APPLICATIONS

The present application is a National Phase application of PCT/GB00/00218 filed on Jan. 26, 2000 and published in English, which claims priority from Application GB 9901641.2 filed on Jan. 26, 1999.

FIELD OF THE INVENTION

This invention relates to crimping of composite electrical insulators for high, medium, or low voltage use.

BACKGROUND OF THE INVENTION

A composite insulator comprises a structurally strong core or rod typically made of fibreglass, a series of electrically insulating sheds, and two metal end fittings crimped onto the exposed ends of the electrical insulator. The insulator assembly, and therefore the crimped joint must be able to withstand tensile forces as per particular specification (SML=Specified Mechanical Load) of the insulator.

A major failure mode of composite insulators is cracking of the fibre glass rod inside the metal end fitting during the crimping process. In this process, a hydraulic press is used to drive the dieset in the radial direction towards the rod. During the forward stroke, the dies crimp the circumference of the metal end fitting. This crimping action compresses the steel onto the fibre glass rod while permanently deforming the steel. Due to the specific material properties of fibre glass, such a rod has a great structural strength in its longitudinal direction but a limited structural strength in its radial direction.

Cracking during crimping occurs when the compressive stresses induced in the fibre glass rod due to over-crimping exceed the compressive strength of the rod in the transverse direction. Also, stress concentrations can also be induced due to surface roughness in the drilled bore in the steel end fitting. These stress concentrations can cause rod failures during crimping, resulting in a weak mechanical coupling between the rod and the end fittings.

The traditional method of crack detection throughout the industry is acoustic monitoring, that is using suitable acoustic monitors and amplifiers to detect the noise of cracking as it occurs during the crimping operation. It has shown, however, that the acoustic monitoring method is difficult to employ. In practice, therefore, the monitoring is often limited to occasional samples instead of entire production runs, resulting in some defective joints not being detected.

SUMMARY OF THE INVENTION

It is therefore an object of the present invention to provide a method of monitoring the crimping of metal end fittings onto a rod which provides greater reliability.

It is another object of the present invention to provide a method of monitoring the crimping of metal end fittings onto a rod which is economical and easy to employ.

It is still another object of the present invention to provide a crimping device capable of monitoring the crimping of metal end fittings onto a rod, such as a fibreglass rod.

Accordingly, a method of monitoring the crimping of metal end fittings onto an electrically insulating core rod of an electrical insulator using a crimping apparatus having crimping jaws is in accordance with the present invention characterised by

- measuring the force and/or pressure applied to the end fittings by the crimping jaws during the crimping,
- measuring the distance travelled by the jaws during the crimping,
- detecting a non-increasing force and/or pressure with an increasing distance.

The present invention thus provides a novel method to detect rod failure by cracking or matrix failure during the crimping operation which uses force and/or pressure transducers to monitor and predict rod cracking. By using force and/or pressure transducers, a direct indication of the stresses in the fibre glass rod are obtained, in contrast to the indirect indication provided by acoustic monitoring. Also, the monitoring is carried out as a continuous process during the crimping operation and can be employed during an entire production run, thus offering greater reliability. Another advantage is the possibility to immediately discard the insulator when severe cracks are detected, thus saving additional process steps.

The use of transducers for monitoring crimping processes is known as such for crimping electrical connectors onto wires. European patent application EP 0,460,441, for example, discloses a method for determining the quality of an electrical connection when crimping an electical connector onto a metal wire. The quality of the electrical connection is monitored by collecting force and displacement data and comparing those data with standard data. There is no crimping onto a rod having a relatively fragile structure, such as a fibreglass rod. Also, the crimping process monitored is intended to provide a good electrical connection, whereas the quality of the mechanical connection and the resistance to tensile forces is only of secundary importance.

European patent application EP 0,397,434 also discloses a method for monitoring the crimping of electrical connectors onto metal wires and therefore addresses different problems than the present invention. A similar method of monitoring the crimping onto wire is disclosed in U.S. Pat. No. 5,168,736. None of these documents address the problems associated with crimping end fittings onto the fibre glass rod of an electrical insulator.

In the method of the present invention, the ratio of the force applied and the distance travelled and/or the ratio of the pressure applied and the distance travelled may be calculated and a change in any such ratio may be used to detect a substantially non-increasing force or pressure with an increasing distance. Alternatively, or additionally, the force applied and the distance travelled and/or the pressure applied and the distance travelled may be displayed to enable a visual detection of a non-increasing force and/or pressure applied with an increasing distance travelled.

Although the invention is explained by way of an embodiment in which the distance travelled is used to monitor the crimping process, the time elapsed during the crimping process may measured and used instead of or in addition to the distance travelled. When using the time elapsed as a variable it is preferred to detect a decrease in the force or pressure applied within a certain time period.

As explained above, the present invention provides a new and advantageous quality control method that can be used to detect failure of the fibre glass rod during the crimping process. Incorporating this technology into crimping machines will lead to improved quality assurance on the mechanical properties of the insulator. Accordingly, the present invention also provides a crimping apparatus having crimping jaws for crimping metal end fittings onto an electrically insulating core rod of an electrical insulator, which crimping apparatus is characterized by force and/or pressure transducers associated with the jaws so as to be capable of monitoring the progress of the crimping operation to detect over-crimping by measuring the force and/or pressure applied by the jaws to the end fittings being crimped and the distance travelled by the jaws.

Advantageously, the transducers are accomodated in crimping dies mounted on the jaws. This requires a modification of the dies only, not of the jaws. In a preferred embodiment, the dies consist of fixed master dies and interchangeable crimping dies, the transducers being accomodated in the master dies. This ensures that the transducers are present in the crimping device irrespective of the particular crimping dies used. Also, only a single transducer or set of transducers is necessary in this embodiment, as there is no need to provide the individual interchangeable crimping dies with transducers.

BRIEF DESCRIPTION OF THE DRAWINGS

The present invention will be further be explained with reference to the accompanying drawings, in which.

DETAILED DESCRIPTION OF THE ILLUSTRATED EMBODIMENTS

Figure 1:
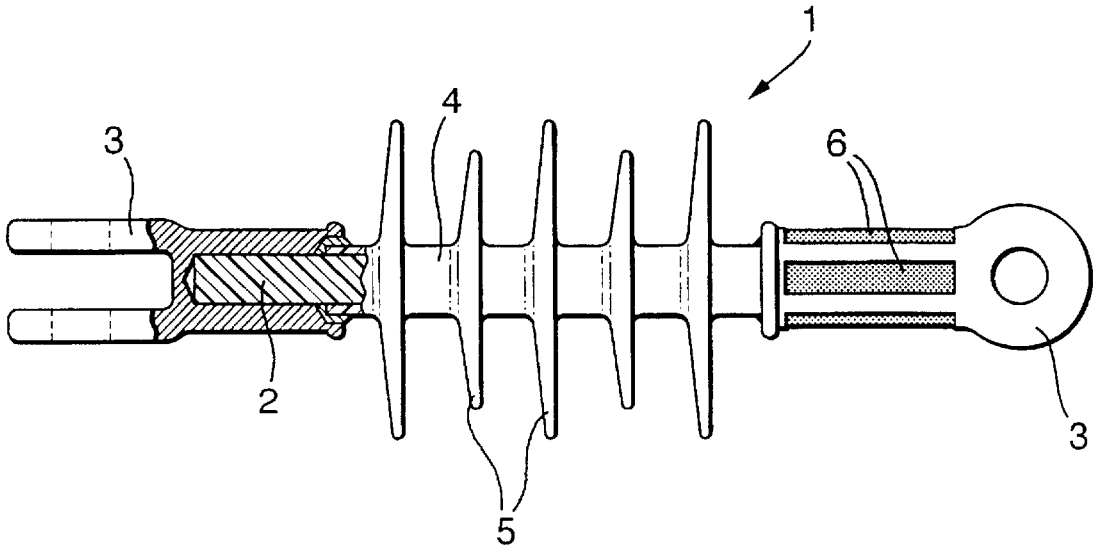
FIG. 1 schematically shows, in partial cross-section, an insulator having a rod and crimped-on end fittings.

The electrical insulator unit 1 shown by way of example in FIG. 1 comprises an electrically insulating core rod 2 of an electrically insulating material, such as fibre glass. At both ends the rod 2 is provided with metal end fittings 3. The length of rod between the end fittings 3 is enclosed by a housing 4 having sheds 5. The housing 4 is preferably made of a polymeric material and may be shrink-fitted onto the rod 2.

The end fittings 3 are fixed onto the rod 2 by crimping the fittings at crimping areas 6, as will further be explained with reference to FIGS. 2*a* and 2*b*. By crimping the end fittings a minimum number of components is used. It has been found, however, that the crimping process may cause cracks to appear in the rod, resulting in a severely reduced resistance of the insulator to tensile forces.

Figure 2A:
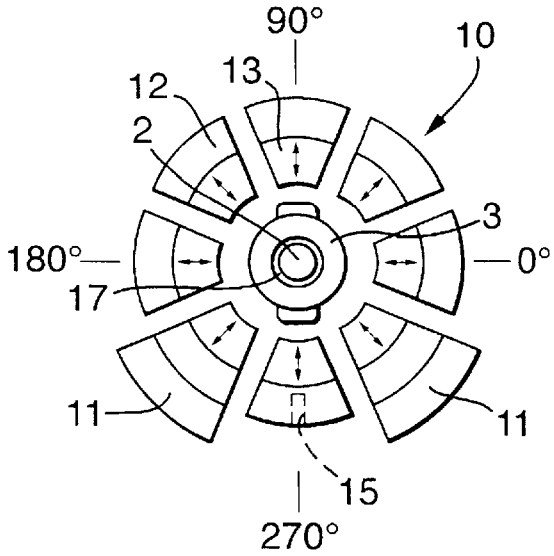
FIGS. 2*a* and 2*b* schematically show, in partial cross-section, a crimping arrangement according to the present invention.
Figure 2B:
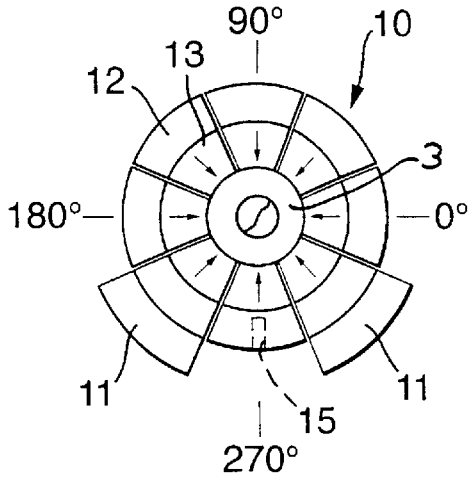

As schematically shown in FIGS. 2*a* and 2*b*, a crimping device may comprise a number of crimping jaws 11. In the present example the device comprises eight jaws 11, of which only two are shown for the sake of clarity of the illustration. Instead of eight jaws 11 other numbers, such as six, are also feasible. On each jaw 11 a separate die is mounted. In the embodiment shown, each die consists of a master die 12 and a crimping die 13. The eight master dies 12 may be permanently fixed to the respective jaws. The crimping dies 13 are each releasably and interchangeably mounted on a master dies 12 by means of, for example, suitable bolts (not shown). The wedge-shaped die arrangements enclose an insulator 1 of which the end fittings 3 are to be crimped onto the rod 2. Initially there is a clearance 17 between the rod 2 and the end fitting 3. During the crimping process the dies move towards the insulator, as illustrated in FIG. 2*b*, and exert pressure on the end fittings 3 so as to permanently deform them and provide a press-fit.

In accordance with the present invention, a force or pressure transducer 15 is positioned in a crimping machine master die 12, in the example shown orientated in the 270° position (0° being at the right of the arrangement). The transducer's output signal is fed to an amplifier (not shown) which converts it into a signal indicative of force. The distance travelled by the dies is measured using well-known displacement transducers or optical displacement measurement devices.

FIG. 3 illustrates the output from the transducer (sensor) plotted against the distance travelled by the dies 12 and 13 in the radial direction. This information can be used to clearly indicate if a fibre glass rod has cracked during crimping.

Figure 3A:
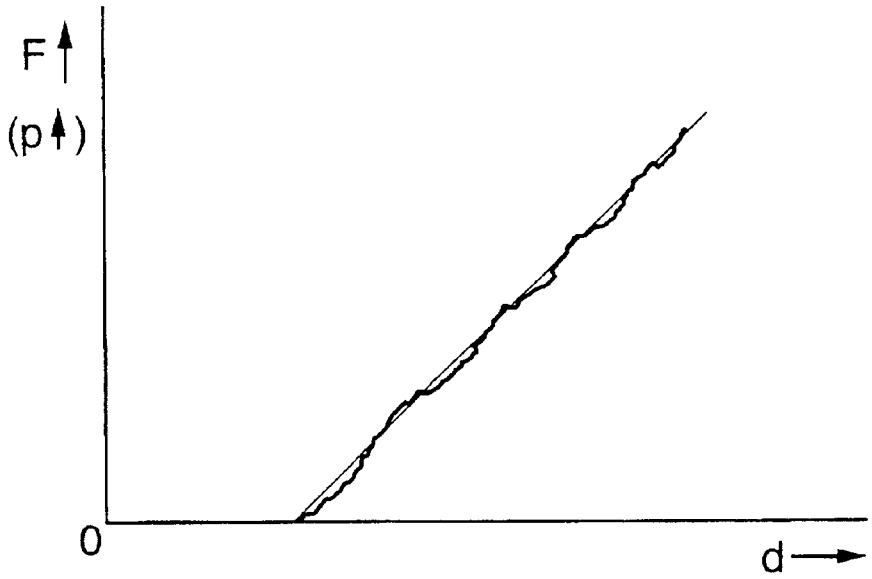
FIGS. 3*a* and 3*b* schematically show graphical representations of the force versus the distance during crimping processes.

In the case of a normal crimping process in which no fracture occurs the force F or pressure p (plotted against the vertical axis) increases approximately linearly with the distance d travelled, plotted against the horizontal axis. This is shown in FIG. 3*a*. A substantially linear relationship between the force F (Y-axis) and the distance d (X-axis), as illustrated by the thin auxiliary line in FIG. 3*a*, is therefore indicative of a good crimping operation.

Figure 3B:
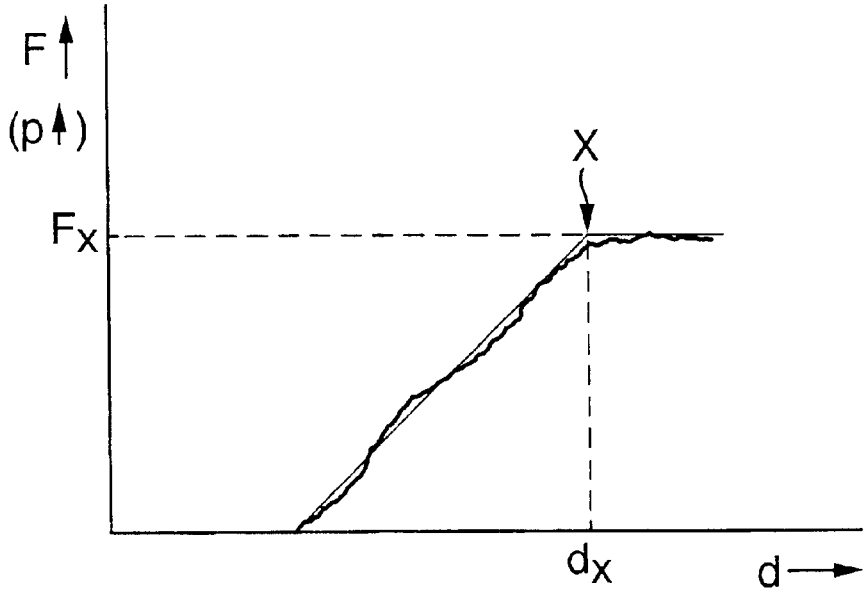

In the case of the rod fracture, there is an instantaneous increase in crimp distance without change in the force exerted, as shown in FIG. 3*b*. This instantaneous increase in distance is indicated clearly by the sudden change in the slope of the graph at X. At a distance $d_x$ the force F does not increase above a maximum force $F_x$, indicating a crack in the rod. This result consistently differentiates between cracked and undamaged rods during crimping.

The fracture can be visually detected by showing the graph of FIG. 3*b* on a display screen. Alternatively, a machine-aided detection can be carried out by calculating at predetermined intervals (for example every 0.1 second) the ratio of the force and the distance (more in particular: the ratio of the force increase and the distance increase) and producing an alert message when the ratio changes by more than a predetermined percentage, for example 25% or 50%. It will be understood by those skilled in the art that various techniques may be used to optimise this detection process, such as averaging the ratio over a number of e.g. 5 or 10 samples.

Figure 4A:
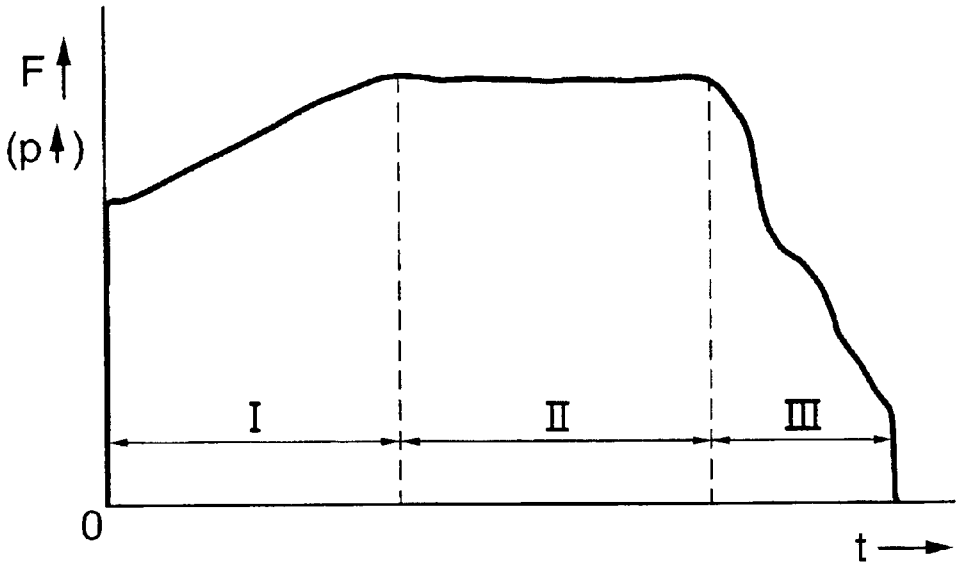
FIGS. 4*a* and 4*b* schematically show graphical representations of the force versus the time during crimping processes.
Figure 4B:
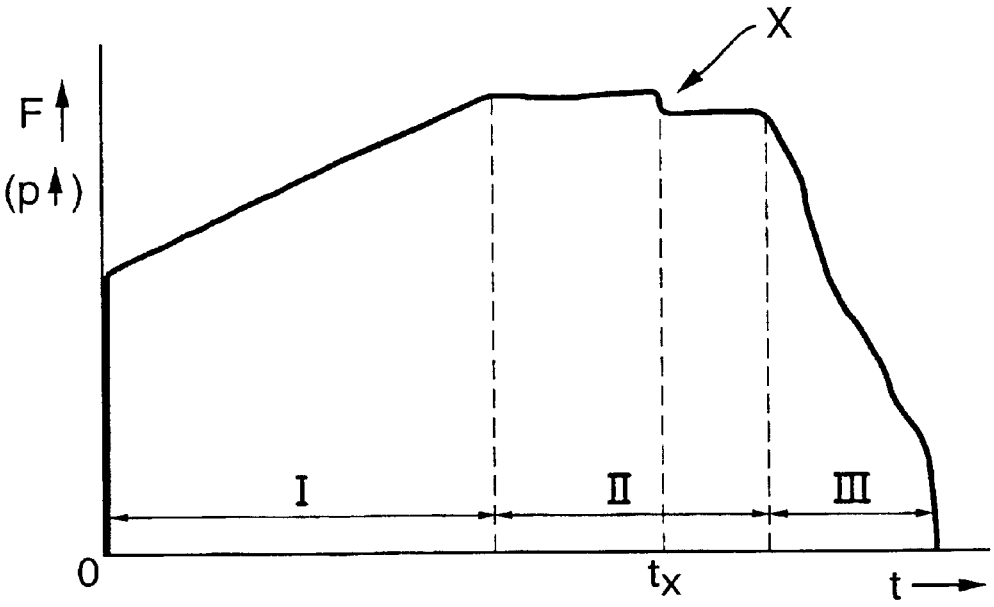

The graphs of FIGS. 4*a* and 4*b* illustrate an alternative embodiment of the present invention, which can be used instead of or in addition to the embodiment described above. In FIG. 4*a* the applied force over time is shown for a crimping process in which no cracks occur. The force initially increases over time, typically at a predetermined rate (ramp). This first period is indicated by I in FIG. 4*a*. When a predetermined maximum force is reached, that force is maintained during a second period, indicated by II. Finally, the force is reduced to zero during a third period, indicated by III. As can be seen from FIG. 4*a*, the graph is relatively smooth, having a substantially constant slope during period I and a substantially contant level (force) during period II.

In FIG. 4*b* the applied force over time is shown for a crimping process in which cracks do occur. The graph is very similar to that of FIG. 4*a*. However, a crack occurs at time $t_x$, resulting in a sudden decrease in the applied force. This point is in the graph indicated by X. In the example shown, the crack and the resulting decrease in the force measured by the transducer occur in period II. It will be understood that a crack may also occur in period I. When a crack occurs during period I, it also affects the slope of the graph. In this embodiment, however, the detection criterion is a decrease rather than the absence of an increase. It has been shown that in practice the decrease in measured force is easy to detect.

It will be understood that the graphs of FIGS. 4*a* and 4*b* apply equally well to pressure over time.

As will be clear from the above, a standard crimping machine can be easily modified by adding force and/or pressure transducers. The present invention, therefore, requires no elaborate or expensive modifications to existing equipment.

EXAMPLE

A standard crimping machine was modified by adding monitoring force transducers.

The main crimping variables crimp pressure, crimp distance, crimp hold time and load ramp rate were established as being the key crimping parameters. As a result these were chosen as the basis for a Taguchi trial, table 1.1, the purpose of the trial being to examine the sensitivity of the machine to these parameters. The tests were also designed such that failure of the crimped joint would be induced in some tests. Resultant pressure measured in the hydraulic head, distance travelled by the dies and force measured in the base dies were recorded and logged during the crimping operation. During the destructive testing, force was plotted against elongation. Destructive test loads were applied at a pre-specified ramp rate (kN/minute) up to failure.

TABLE 1

| Exp No. | Press - 1 | Press - 2 | Ramp rate | Hold time | Samples |
|---|---|---|---|---|---|
| 1 | 9 | 95 | 5 | 4 | 3 |
| 2 | 9 | 100 | 30 | 7 | 3 |
| 3 | 9 | 105 | 55 | 10 | 3 |
| 4 | 9 | 95 | 30 | 10 | 3 |
| 5 | 9 | 100 | 55 | 4 | 3 |
| 6 | 9 | 105 | 5 | 7 | 3 |
| 7 | 9 | 95 | 55 | 7 | 3 |
| 8 | 9 | 100 | 5 | 10 | 3 |
| 9 | 9 | 105 | 30 | 4 | 3 |

Press - 1: preload pressure, pressure at which the machine senses the end fitting and starts the ramping of the pressure to a set rate.
Press - 2: crimp pressure.
Ramp rate: rate at which Press - 2 is applied.
Hold time: time for which the crimp pressure (Press - 2) is maintained.

The transducers (force sensors) were positioned in the base (master) dies to eliminate the necessity to fit sensors to each individual dieset. Refer to FIG. 2*a* for the position of the sensors. In all there were three 'master dies' machined take the two force transducers fitted. These were the dies positioned in the 90°, 180° and 270° positions. The two sensors were fitted with a view to comparing the force transmitted to the end fitting at the front and rear of the die. The sensors and amplifier used for this modification were sourced from KISTLER instruments.

It was found preferable that, due to the mechanical configuration of the crimping head, the force transducers should be placed in the master die positioned at 270°, refer to FIG. 2*a*.

Taguchi trials: during the first batch of trials, 27 samples were crimped and the crimping variables recorded for each crimp. Crimp 'A' being the first side and crimp 'B' being the second side crimped. The variable information was gathered in the format of FIG. 3.

Note at this stage that the force transducer is was not calibrated to read actual force reading. However, its scaling is in coulombs and relative values were interpreted.

From the characteristic shape of the crimping forces vs displacement curves it was possible to predict the mode of failure of the insulator during the destructive testing. The three potential modes of failure during the destructive tests being:

1. rod break,
2. matrix cracking due to overcrimping, and
3. rod pullout: when the rod pulls out of the end fitting with damage, i.e. no cracking.

FIGS. 3*a* and 3*b* illustrate the defined difference in the curve shape for the clearly undamaged and clearly cracked.

The results listed below summarise the results and predicted mode of failure for each test number, x.1, x.2 & x.3 being the three tests conducted for each set of conditions and A & B denoting identifying the opposite ends of the assembly. The abbreviations used in the tables are explained below.

Predicted mode of failure abbreviations:

G-PO: Good part, breaks or pulls out at load>SML (in kN) of insulator.

| | |
|---|---|
| B: | Break at a load < SML (in kN) of insulator. |
| M: | Matrix cracking |

Mode of failure abbreviations:

| | |
|---|---|
| B: | Break due to high tensile loading. |
| PO: | Pull out. |
| S: | Snipping, fibre damage due to sharp edges at change in bore diameter. |
| R: | Fibre damage due to ridges in the bore due to drilling. |
| C–B: | Rod fracture from crimping. |
| M: | Matrix damage during crimping |

TABLE 2

| Exp No. | Peak pressure recorded | | Predicted mode of failure | Predicted failed end of assembly A or B | Actual mode of failure | Actual failed end of assembly A or B | Failure load kN | Correct Y/N |
|---|---|---|---|---|---|---|---|---|
| 1.1 | 98.1 | 98.3 | G-PO | A | B-R | | 95 | Y |
| 1.2 | 99.5 | 99.8 | G-PO | A | B-S | | 110 | Y |
| 1.3 | 98.5 | 98.3 | B | A/B | B | | 93 | Y/N |
| 2.1 | 104.7 | 104.7 | G-PO | A | B-R | | 110 | Y |
| 2.2 | 106.1 | 104.1 | G-PO | B | B | | 105 | Y |
| 2.3 | / | 104.9 | G-PO | A | B-M | | 115 | Y |
| 3.1 | 111.3 | 111.4 | B | A | B | | 62 | Y |
| 3.2 | 112.8 | / | B | A/B | B | | 59 | Y |
| 3.3 | 112.6 | / | / | / | / | / | / | / |
| 4.1 | 99.1 | 99.5 | / | / | / | | / | / |
| 4.2 | 98.6 | / | G-PO | / | PO | | 110 | Y |
| 4.3 | 99.4 | 99.6 | B | A | B | | 55 | Y |

TABLE 2-continued

| Exp No. | Peak pressure recorded | | Predicted mode of failure | Predicted failed end of assembly A or B | Actual mode of failure | Actual failed end of assembly A or B | Failure load kN | Correct Y/N |
|---|---|---|---|---|---|---|---|---|
| 5.1 | 105.3 | 104.7 | G-PO | B | PO | | 120 | Y |
| 52 | 105.8 | 108.1 | / | / | / | / | / | / |
| 5.3 | / | 107.5 | M | A | B | | 115 | Y/N |
| 6.1 | 106.7 | 107.9 | B | B | B | | 70 | Y |
| 6.2 | 107.9 | 107.8 | B | A | B | | 80 | Y |
| 6.3 | 107.7 | 108.1 | B | A/B | B | | 65 | Y |
| 7.1 | 101.8 | 103.7 | B | B | B-PO | | 65 | Y |
| 7.2 | 100.6 | / | G-PO | A | B | | 105 | Y |
| 7.3 | / | 103.3 | M/B | A/B | B | | 105 | Y/N |
| 8.1 | 104.4 | 103.1 | G-PO | A/B | B | | 110 | Y |
| 8.2 | 102.2 | 103.4 | G-PO | B | B | | 100 | Y |
| 8.3 | 104.4 | 102.2 | PO | Insufficient test data | B | | 120 | / |
| 9.1 | 111.5 | 109.2 | B | A | C-B | | 78 | Y |
| 9.2 | 108.6 | 109.5 | M | Insufficient test data | M | | 115 | / |
| 9.3 | 110.3 | 109 | B | Insufficient test data | C-B | | 40 | / |

Based on the above results it was decided that all the crimp pressures employed were too high, therefore crimp pressure set at 93 bar. It was proven that the higher the 5% ramp rate caused higher pressure variation, therefore the minimum ramp rate chosen was 30%. Press-1 was fixed by the machine and the hold time had no evident effect on the final result, therefore shortest hold time chosen, with cycle time in mind.

| | |
|---|---|
| Set Press-1 = | 9 bar |
| Set Press-2 = | 93 bar |
| Hold time = | 4 seconds |
| P/t = | 30 |

Using the above parameters, 15 trials were conducted prove the F vs D theory as a plausable failure detection criterion.

TABLE 3

| Exp No. | Peak pressure recorded | | Predicted mode of failure | Predicted failed end of assembly A or B | Actual mode of failure | Actual failed end of assembly A or B | Failure load | Correct Y/N |
|---|---|---|---|---|---|---|---|---|
| 10.1 | / | / | G-PO | A | B | B | 103.6 | Y |
| 10.2 | 99.1 | 97.9 | G-PO | A/B | B | B | 113.1 | Y |
| 10.3 | 98.8 | 99.0 | G-PO | B | B | B | 111.9 | Y |
| 10.4 | 99.2 | 98.8 | G-PO | A | PO-B | B | 115.6 | Y |
| 10.5 | 98.3 | 100.1 | B | A | ? | ? | 87.2 | Y |
| 10.6 | 99.6 | 97.7 | G-PO | B | B | B | 114.3 | Y |
| 10.7 | 97.1 | 99.6 | G-PO | B | B | B | 106.4 | Y |
| 10.8 | 98.2 | 98.6 | G-PO | B | | ? | 108.3 | Y |
| 10.9 | 98.3 | 98.8 | G-PO | A | B | B | 103.2 | Y |
| 10.10 | 98.7 | 98.2 | G-PO | B | B | B | 109.4 | Y |
| 10.11 | 99.7 | 98.5 | G-PO | A | B | A | 111.7 | Y |
| 10.12 | 99.0 | 98.3 | G-PO | B | B | A | 112.7 | Y |
| 10.13 | 99.2 | 99.3 | G-PO | A | B | ? | 108 | Y |
| 10.14 | 98.2 | 98.8 | G-PO | A | B | B | 111.4 | Y |
| 10.15 | 98.6 | 100.5 | G-PO | B | B | B | 104 | Y |

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

What is claimed is:

1. Method of monitoring the crimping of metal end fittings onto an electrically insulating core rod of an electrical insulator using a crimping apparatus having crimping jaws, comprising:

measuring the force and/or pressure applied to the end fittings by the crimping jaws during the crimping, measuring the distance travelled by the jaws during the crimping, detecting a non-increasing force and/or pressure with an increasing distance during the crimping.

2. Method according to claim 1, wherein the ratio of the force applied and the distance travelled and/or the ratio of the pressure applied and the distance travelled is calculated and a change in any ratio is used to detect a non-increasing force or pressure with an increasing distance.

3. Method according to claim 1, wherein the ratio of the force applied and the distance travelled and/or the ratio of the pressure applied and the distance travelled is calculated and a change in any ratio is used to detect a non-increasing force or pressure with an increasing distance.

4. Method according to claim 1 wherein the time elapsed is measured in addition to the distance traveled.

5. Crimping apparatus having crimping jaws for crimping metal end fittings onto an electrically insulating core rod of an electrical insulator, comprising force and/or pressure transducers associated with the jaws so as to be capable of monitoring the progress of the crimping operation to detect over-crimping by measuring the force and/or pressure applied by the jaws to the end fittings being crimped and the distance traveled by the jaws during crimping.

6. Crimping apparatus according to claim 5, wherein the transducers are accommodated in crimping dies mounted on the jaws.

7. Crimping apparatus according to claim 6, wherein the dies consist of fixed master dies and interchangeable crimping dies, and wherein the transducers are accommodated in the master dies.

8. Crimping apparatus according to claim 5, further provided with display means for displaying output from the transducers so as to enable an operator to detect and/or predict and avoid over-crimping.

9. A method of monitoring crimping of metal end fittings onto an electrically insulating core rod of an electrical insulator using a crimping apparatus having crimping jaws, the method comprising:

measuring a force and/or pressure applied to the end fittings by the crimping jaws while the crimping jaws are moving toward the core rod; and detecting a crimping failure if a non-increasing force and/or pressure is measured while the crimping jaws are moving toward the core rod.

10. The method of claim 9 wherein detecting a crimping failure if a non-increasing force and/or pressure is measured while the crimping jaws are moving toward the core rod comprises detecting a crimping failure if a decreased force and/or pressure is measured while the crimping jaws are moving toward the core rod.

11. The method of claim 9 further comprising measuring a distance traveled by the crimping jaws to determine if the crimping jaws are moving toward the core rod.

12. The method of claim 9 further comprising measuring a time elapsed to determine if the crimping jaws are moving toward the core rod.

13. A crimping apparatus having crimping jaws for crimping metal end fittings onto an electrically insulating core rod of an electrical insulator, the apparatus comprising:

a transducer that measures a force and/or pressure applied to the end fittings by the crimping jaws while the crimping jaws are moving toward the core rod; and a detector that detects a crimping failure if a non-increasing force and/or pressure is measured while the crimping jaws are moving toward the core rod.

14. The apparatus of claim 13 wherein the detector is configured to detected a crimping failure if a decreased force and/or pressure is measured while the crimping jaws are moving toward the core rod.

15. The apparatus of claim 13 further comprising a displacement measurement device that measures a distance traveled by the crimping jaws and provides the measured distance to the detector and wherein the detector is configured to determine if the crimping jaws are moving toward the core rod based on the measured distance.

16. The apparatus of claim 13 wherein the detector is configured to measure a time elapsed to determine if the crimping jaws are moving toward the core rod.

* * * * *